US012766372B2

(12) United States Patent
Andrews

(10) Patent No.: US 12,766,372 B2
(45) Date of Patent: Oct. 20, 2026

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventor: Matthew T. Andrews, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 194 days.

(21) Appl. No.: 18/813,197

(22) Filed: Aug. 23, 2024

(65) Prior Publication Data

US 2025/0281805 A1 Sep. 11, 2025

Related U.S. Application Data

(60) Provisional application No. 63/640,711, filed on Apr. 30, 2024, provisional application No. 63/562,182, filed on Mar. 6, 2024.

(51) Int. Cl.
*A63B 53/14* (2015.01)
*A63B 53/04* (2015.01)

(52) U.S. Cl.
CPC ..... *A63B 53/0445* (2020.08); *A63B 53/0487* (2013.01)

(58) Field of Classification Search
CPC ..... A63B 53/0445; A63B 53/0487; A63B 53/0408; A63B 53/04
USPC ..... 473/330, 331
See application file for complete search history.

(56) References Cited

U.S. PATENT DOCUMENTS

| | | | | |
|---|---|---|---|---|
| 1,503,291 | A | 7/1924 | Rimmer | |
| 1,965,954 | A * | 7/1934 | Henry | A63B 60/00 473/331 |
| 2,034,936 | A | 3/1936 | Barnhart | |
| 4,964,641 | A | 10/1990 | Miesch et al. | |
| 5,437,088 | A | 8/1995 | Igarashi | |
| 5,688,190 | A | 11/1997 | Rowland et al. | |
| 5,690,561 | A | 11/1997 | Rowland et al. | |
| 5,785,610 | A | 7/1998 | Birmingham | |
| 6,007,434 | A | 12/1999 | Baker et al. | |
| 6,217,460 | B1 | 4/2001 | Broadbridge et al. | |

(Continued)

FOREIGN PATENT DOCUMENTS

| | | | |
|---|---|---|---|
| JP | H01166784 | A | 6/1989 |
| JP | 2007160075 | A | 6/2007 |

(Continued)

OTHER PUBLICATIONS

KR 20150114273 Jeong J Eng Trans (Year: 2015).*

*Primary Examiner* — John E Simms, Jr.

(57) ABSTRACT

Embodiments of golf club heads and methods to manufacture golf club heads are generally described herein. In one example, a golf club head may include a face portion having a first plurality of major and minor grooves and a second plurality of major and minor grooves oppositely mirroring the first plurality of major and minor grooves. The first plurality of major grooves may have greater widths than the first plurality of minor grooves and the second plurality of major grooves may have greater widths than the second plurality of minor grooves, a plurality of projections may be defined by the first and second plurality of major and minor grooves. Other examples and embodiments may be described and claimed.

20 Claims, 6 Drawing Sheets

(56) References Cited

U.S. PATENT DOCUMENTS

| | | | |
|---|---|---|---|
| 6,257,994 | B1 | 7/2001 | Antonious |
| 6,277,033 | B1 | 8/2001 | Krumme et al. |
| 6,368,231 | B1 | 4/2002 | Chen |
| 7,278,926 | B2 | 10/2007 | Frame |
| 7,297,071 | B2 | 11/2007 | Hyman |
| 7,452,283 | B2 | 11/2008 | Hettinger et al. |
| 7,566,276 | B2 | 7/2009 | Billings |
| 7,918,747 | B2 | 4/2011 | Johnson et al. |
| 7,942,758 | B2 | 5/2011 | Nakamura |
| D639,367 | S | 6/2011 | Reinberg |
| 8,109,841 | B2 | 2/2012 | Miyamichi |
| 8,371,958 | B2 | 2/2013 | Treadwell |
| 8,636,607 | B2 | 1/2014 | Renna |
| 8,696,492 | B1 | 4/2014 | Hocknell et al. |
| D711,483 | S | 8/2014 | Wong |
| 8,858,361 | B2 | 10/2014 | Ripp et al. |
| 9,108,088 | B2 | 8/2015 | Serrano et al. |
| 9,272,193 | B1 | 3/2016 | Yim |
| 9,539,477 | B2 | 1/2017 | Ripp et al. |
| 9,566,480 | B2 | 2/2017 | Voges |
| 9,943,735 | B2 | 4/2018 | Rife |
| 9,987,530 | B2 | 6/2018 | Jertson et al. |
| 10,238,932 | B2 | 3/2019 | Becktor et al. |
| 10,343,034 | B2 | 7/2019 | Henrikson et al. |
| 10,493,331 | B2 | 12/2019 | Kroloff et al. |
| 10,583,338 | B2 | 3/2020 | Jertson et al. |
| 10,632,352 | B2 | 4/2020 | Lambeth et al. |
| 10,668,340 | B2 | 6/2020 | Lambeth et al. |
| 10,737,153 | B2 | 8/2020 | Schweigert et al. |
| 10,835,788 | B1 | 11/2020 | Rice et al. |
| 10,960,271 | B2 | 3/2021 | Kroloff et al. |
| 10,981,038 | B2 | 4/2021 | Schweigert et al. |
| 11,090,535 | B1 | 8/2021 | Schweigert et al. |
| D930,096 | S | 9/2021 | Higdon et al. |
| D931,962 | S | 9/2021 | Wang et al. |
| 11,130,028 | B2 | 9/2021 | Lambeth et al. |
| 11,141,635 | B2 | 10/2021 | Schweigert et al. |
| 11,161,020 | B2 | 11/2021 | Henrikson et al. |
| 11,161,021 | B2 | 11/2021 | Becktor et al. |
| 11,420,100 | B2 | 8/2022 | Wang et al. |
| D967,914 | S | 10/2022 | Higdon et al. |
| D978,268 | S | 2/2023 | Kamiya et al. |
| D979,680 | S | 2/2023 | Wang et al. |
| 11,583,738 | B2 | 2/2023 | Schweigert et al. |
| D1,008,390 | S | 12/2023 | Serrano |
| 11,839,801 | B2 | 12/2023 | Parsons et al. |
| D1,012,213 | S | 1/2024 | Serrano |
| 2004/0014532 | A1 | 1/2004 | Lee et al. |
| 2007/0142122 | A1 | 6/2007 | Bonneau |
| 2009/0156328 | A1 | 6/2009 | Reese |
| 2016/0016050 | A1 | 1/2016 | Rife |
| 2016/0346649 | A1 | 12/2016 | Jertson et al. |
| 2018/0001163 | A1* | 1/2018 | Becktor ..... A63B 53/04 |
| 2018/0311545 | A1* | 11/2018 | Lambeth ..... A63B 53/0487 |
| 2018/0361211 | A1* | 12/2018 | Lambeth ..... A63B 53/0487 |
| 2021/0138322 | A1* | 5/2021 | Wang ..... A63B 53/0487 |
| 2021/0245019 | A1 | 8/2021 | Schweigert et al. |
| 2022/0016501 | A1* | 1/2022 | Becktor ..... A63B 53/04 |

FOREIGN PATENT DOCUMENTS

| | | | | |
|---|---|---|---|---|
| JP | 2008154975 | A | 7/2008 | |
| JP | 2009136514 | A | 6/2009 | |
| JP | 2010035704 | A | 2/2010 | |
| JP | 2018000925 | A | 1/2018 | |
| JP | 2018015548 | A | 2/2018 | |
| JP | 2018187369 | A | 11/2018 | |
| JP | 2020120712 | A | 8/2020 | |
| KR | 101578821 | B1 | 12/2015 | |
| KR | 20150114273 | * | 12/2015 | ..... A63B 53/04 |
| WO | 2015005593 | A1 | 1/2015 | |

* cited by examiner

GOLF CLUB HEADS AND METHODS TO MANUFACTURE GOLF CLUB HEADS

CROSS REFERENCE

This application claims the benefits of U.S. Provisional Application Nos. 63/640,711, filed Apr. 30, 2024, and 63/562,182, filed Mar. 6, 2024, the disclosures of which are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

BACKGROUND

Putter-type golf club heads may include groove patterns formed in a face portion. The groove patterns may affect certain physical properties of a golf club head such as sound and feel.

DESCRIPTION OF THE DRA WINGS

Figure 1:
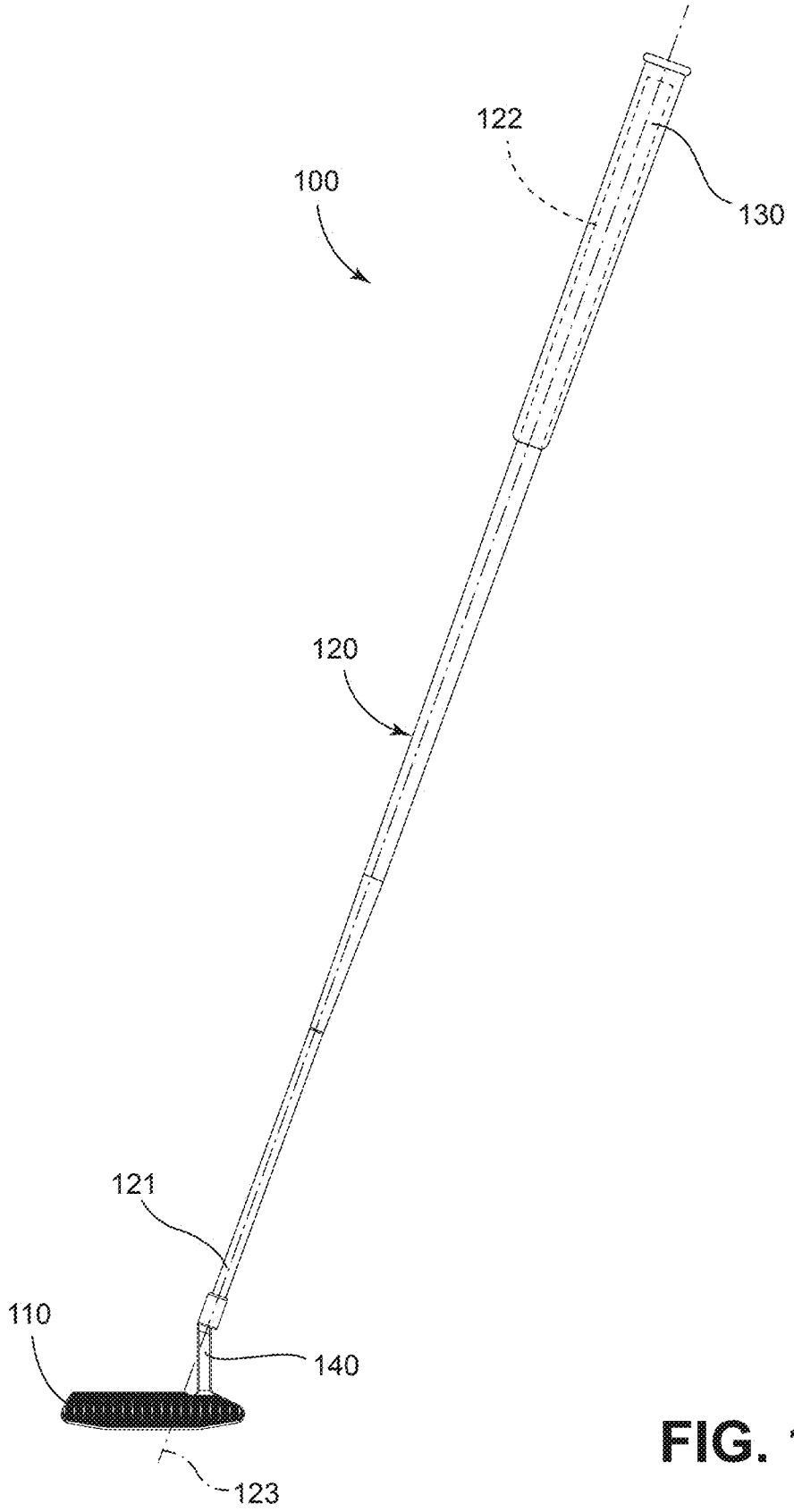
FIG. 1 depicts a front view of a golf club according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

The following U.S. Patents and Patent Applications, which are collectively referred to herein as "the incorporated by reference patent documents," are incorporated by reference herein in their entirety: U.S. Pat. Nos. 9,233,283; 9,387,375; 9,440,124; 9,649,540; 9,895,585; 10,478,680; 10,493,331; 10,576,339; 10,737.153; 10.821.341; 10.960.271; 10.981.038; 11.045.698; 11,298.597; 11,369,849; and 11,517,798; 11,839,801; 11,918,869; and U.S. Patent Publication Nos. 20180200589; 20220219054; and 20230338795.

In general, golf club heads and methods to manufacture golf club heads are described herein. The apparatus, methods, and articles of manufacture described herein are not limited in this regard.

In the example of FIG. 1, a golf club 100 is generally shown as a putter-type golf club. The golf club 100 may include a golf club head 110, a shaft 120, a grip 130, and a hosel portion 140. The shaft 120 may have a first end portion 121 and a second end portion 122 and may define a shaft axis 123 that may or may not intersect with the golf club head 200. The second end portion 122 of the shaft 120 may be coupled to the grip 130 and the first end portion 121 of the shaft 120 may be coupled to the hosel portion 140. The hosel portion 140 may be coupled to the golf club head 110 via a hosel bore or may be integral with the golf club head 110 or otherwise coupled to the golf club head 110. The golf club head 110 may have a head mass greater than or equal to 300 grams and less than or equal to 400 grams. The shaft 120 may be formed from a metal material, a composite material, or any other suitable material or combination of materials. The grip 130 may be formed from a rubber material, a polymer material, or any other suitable material or combination of materials. Additional examples of golf clubs and golf club heads may be found in the incorporated by reference patent documents. The apparatus, methods, and articles of manufacture described herein are not limited in this regard.

Figure 2:
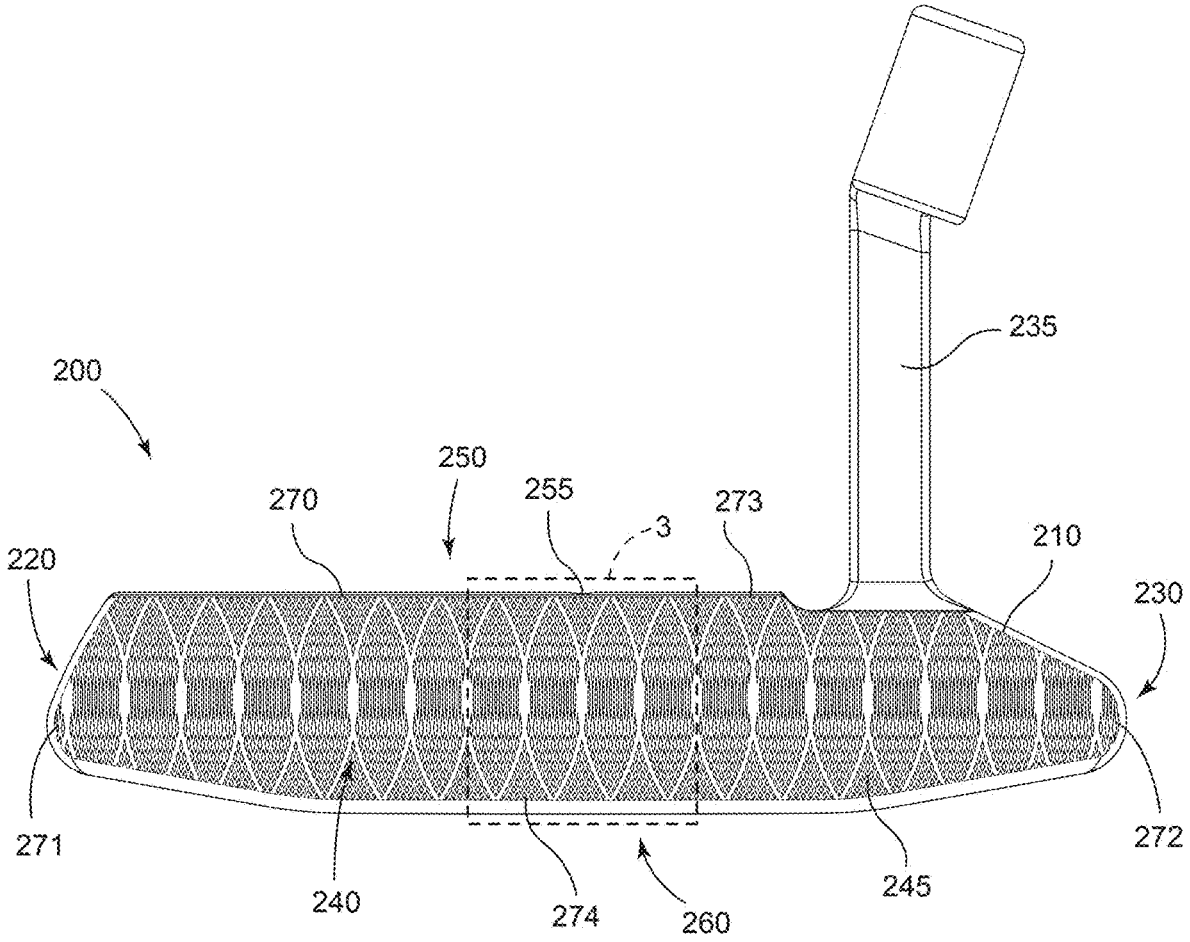
FIG. 2 depicts a front view of a golf club head having a face portion according to an embodiment of the apparatus, methods, and articles of manufacture described herein.

In the example of FIG. 2, a golf club head 200 may include a body portion 210 having a toe portion 220, a heel portion 230, a front portion 240, a rear portion (not shown), a top portion 250, and a sole portion 260, a hosel portion 235 may be located at the heel portion 230. In one example, the hosel portion 235 may be integral with the body portion 210. In another example, the hosel portion 235 may be separately provided and coupled to the body portion 210 via a hosel bore. In yet another example, the body portion 210 may not include a hosel portion such that a shaft (such as the shaft 120) may be directly coupled to the body portion 210. An alignment aid 255 may be located at the top portion 250 and may extend in a center longitudinal direction of the body portion 210. The alignment aid 255 may be visually differentiated (e.g., different color) from the body portion 210 to assist an individual with addressing a golf ball. While not shown, the body portion 210 may include a filler material disposed within an interior cavity and/or may include mass portions for adjusting certain mass properties of the golf club head 200, examples of which may be found in the incorporated by reference patent documents. The body portion 210 may be manufactured via various manufacturing methods and/or processes (e.g., a casting process, a forging process, a milling process, a cutting process, a grinding process, a welding process, a combination thereof, etc.). In one example, the body portion 210 may be constructed partially or entirely from one or a combination of metal-based materials, including but not limited to, aluminum-based materials (e.g., a high-strength aluminum alloys or a composite aluminum alloys coated with a high-strength alloy), magnesium-based materials, stainless steel-based materials, titanium-based materials, tungsten-based materials, or any suitable materials. In another example, the body portion 210 may be constructed partially or entirely from one or a combination of non-metal materials, including but not limited to, composite materials, polymer materials, wood, or any suitable non-metal material. In yet another example, the body portion 210 may be constructed partially or entirely from one or a combination of any of the metal and non-metal materials described herein. The apparatus, methods, and articles of manufacture described herein are not limited in this regard.

The golf club head 200 may include a face portion 245 (e.g., a strike face) located at the front portion 240. The face portion 245 may extend between the toe portion 220 and the heel portion 230 and between the top portion 250 and the sole portion 260. The face portion 245 may include a perimeter 270 defined by a toe edge 271, a heel edge 272, a top edge 273, and a sole edge 274. The face portion 245 may be integral with the body portion 210 or a separate piece coupled to the body portion 210. The face portion 245 may be configured in a variety of shapes and sizes to suit different types of putter heads, such as, but not limited to, a blade style putter head, a mid-mallet style putter head, and a mallet style putter head. Additional examples of types of putter heads may be found in the incorporated by reference patent documents. The apparatus, methods, and articles of manufacture described herein are not limited in this regard.

Figure 3:
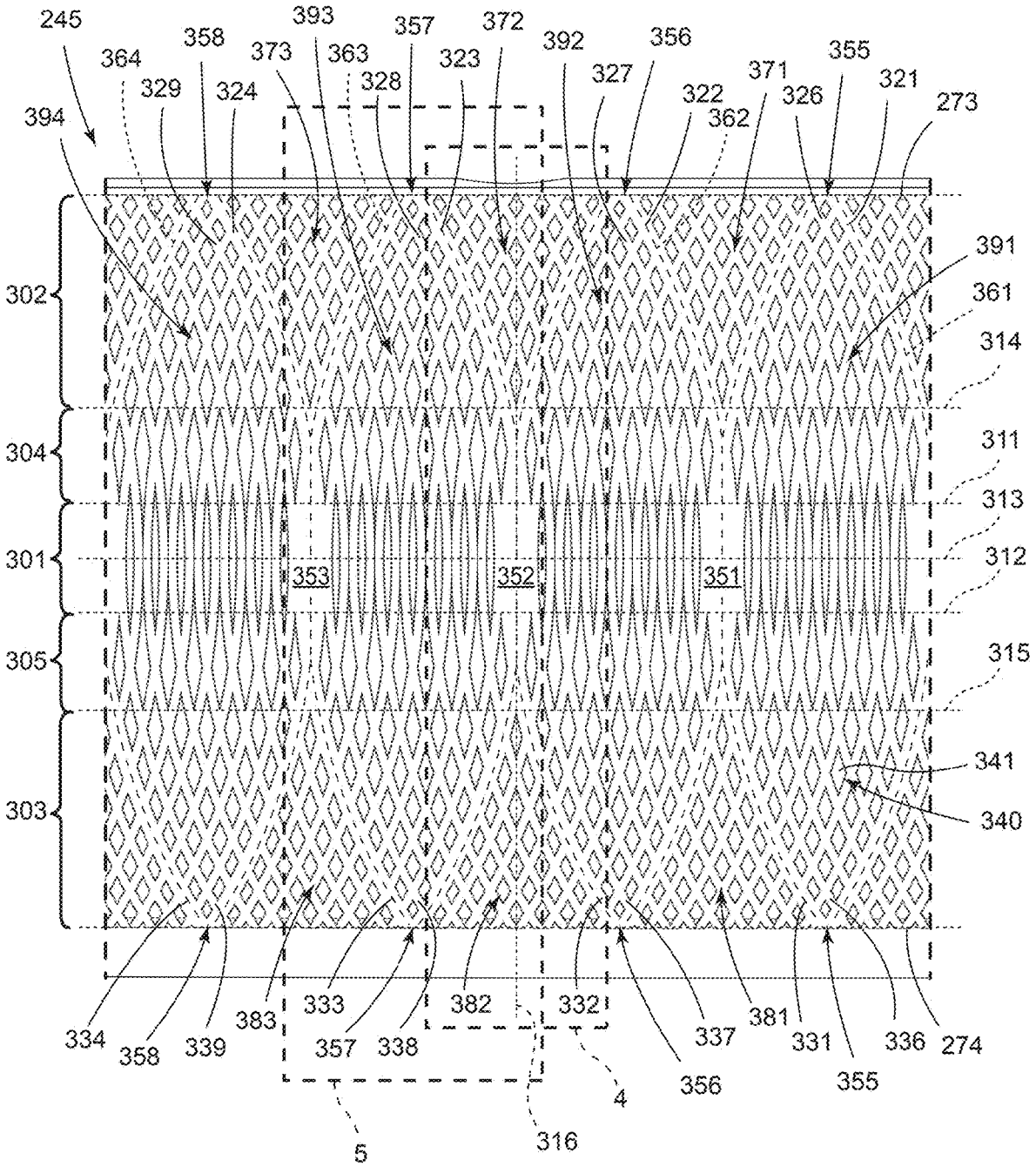
FIG. 3 depicts an enlarged view of area 3 of the face portion of FIG. 2.

In the example of FIG. 3, the face portion 245 may include a center region 301, an upper region 302, a lower region 303, an upper intermediate region 304, and a lower intermediate region 305, which may be collectively referred to herein as the "face regions" of the face portion 245. Additionally, the upper intermediate region 304, the lower intermediate region 305, and the center region 301 may be collectively referred to herein as the "middle face portion" of the face portion 245. The center region 301 may be defined by a region of the face portion 245 between a first horizontal plane 311 and a second horizontal plane 312. The first horizontal plane 311 and the second horizontal plane 312 may be parallel to and equidistant from a center horizontal plane 313 generally located halfway between the top edge 273 and the sole edge 274 of the face portion 245. The upper region 302 may be defined by a region of the face portion 245 between the top edge 273 and a third horizontal plane 314 located between the first horizontal plane 311 and the top edge 273. The lower region 303 may be defined by a region of the face portion 245 between the sole edge 274 and a fourth horizontal plane 315 located between the second horizontal plane 312 and the sole edge 274. The upper intermediate region 304 may be located between the center region 301 and the upper region 302 or defined by a region of the face portion 245 between the first horizontal plane 311 and the third horizontal plane 314. The lower intermediate region 305 may be located between the center region 301 and the lower region 303 or defined by a region of the face portion between the second horizontal plane 312 and the fourth horizontal plane 315. The center horizontal plane 313 may intersect with a center vertical plane 316 generally located halfway between the toe edge 271 and the heel edge 272 of the face portion 245. The intersection between the center horizontal plane 313 and the center vertical plane 316 may include a geometric center of the face portion 245. In one example, the center region 301 may extend a length along the center vertical plane 316 greater than or equal to 0.1070 inch (2.7178 mm) and less than or equal to 0.1450 inch (3.6830 mm). The upper and lower regions 302 and 303 may each extend a length along the center vertical plane 316 greater than or equal to 0.2120 inch (5.3848 mm) and less than or equal to 0.2880 inch (7.3152 mm). The upper and lower intermediate regions 304 and 305 may each extend a length along the center vertical plane 316 greater than or equal to 0.0970 inch (2.4638 mm) and less than or equal to 0.1320 inch (3.3528 mm). Accordingly, the upper and lower regions 302 and 303 may each extend the greatest length along the center vertical plane 316 followed in turn by the center region 301 and the upper and lower intermediate regions 304 and 305, respectively. The apparatus, methods, and articles of manufacture described herein are not limited in this regard.

The face portion 245 may include a groove pattern defined by a first plurality of major grooves (e.g., shown as major grooves 321, 322, 323, and 324) and a first plurality of minor grooves (e.g., shown as minor grooves 326, 327, 328, and 329) generally intersecting with a second plurality of major grooves (e.g., shown as major grooves 331, 332, 333, and 334) and a second plurality of minor grooves (e.g., shown as minor grooves 336, 337, 338, and 339) to produce a plurality of projections 340 each defining a peak surface area (e.g., peak surface area 341) capable of contacting a golf ball during a golf swing. The first plurality of major and minor grooves may be spaced across the face portion 245 in a horizontal or heel-to-toe direction. The first plurality of major and minor grooves may be parallel to each other and may each extend in a first arcuate or curved direction between the top edge 273 and the sole edge 274. The second plurality of major and minor grooves may also be spaced across the face portion 245 in the horizontal or heel-to-toe direction. In contrast, the second plurality of major and minor grooves may extend in a second arcuate or curved direction between the top edge 273 and the sole edge 274. The first arcuate direction and the second arcuate direction may be opposite to each other to enable the first plurality of major and minor grooves to be arranged in mirror opposition to the second plurality of major and minor grooves. In the illustrated example, the first plurality of major and minor grooves may be convex in a heel-ward direction and the second plurality of major and minor grooves may be convex in a toe-ward direction. The apparatus, methods, and articles of manufacture described herein are not limited in this regard.

The first plurality of major and minor grooves may be configured such that any two successive major grooves of the first plurality of major grooves (e.g., major grooves 322 and 323) may be separated by one or more minor grooves of the first plurality of minor grooves (e.g., minor groove 327). In the illustrated example, any two successive major grooves of the first plurality of major grooves may be separated by seven minor grooves of the first plurality of minor grooves. In one example, the first plurality of major and minor grooves may be evenly spaced apart by a distance greater than or equal to 0.0160 inch (0.4064 mm) and less than or equal to 0.0200 inch (0.5080 mm). The second plurality of major and minor grooves may be configured such that any two successive major grooves of the second plurality of major grooves (e.g., major grooves 332 and 333) may be separated by one or more minor grooves of the second plurality of minor grooves (e.g., minor groove 338). In the illustrated example, any two successive major grooves of the second plurality of major grooves may be separated by seven minor grooves of the second plurality of minor grooves. In one example, the second plurality of major and minor grooves may be evenly spaced apart by a distance greater than or equal to 0.0160 inch (0.4064 mm) and less than or equal to 0.0200 inch (0.5080 mm). Each major groove of the first and second plurality of major grooves may have a width that is greater than a width of each minor groove of the first and second plurality of minor grooves. In one example, each major groove of the first and second plurality of major grooves may have a similar width at the center horizontal plane 313 greater than or equal to 0.0200 inch (0.5080 mm) and less than or equal to 0.024 inch (0.6096 mm) and each minor groove of the first and second plurality of minor grooves may have a similar width at the center horizontal plane 313 greater than or equal to 0.0100 inch (0.2540 mm) and less than or equal to 0.0140 inch (0.3556 mm). In another example, each major groove of the first and second plurality of major grooves may have a width at the center horizontal plane 313 that is more than one and a half times greater than a width of each minor groove minor groove of the first and second plurality of minor grooves. Additionally, the first and second plurality of major and minor grooves may have similar or different depths. In one example, each major groove of the first and second plurality of major grooves and each minor groove of the first and second plurality of minor grooves may have a uniform or variable depth greater than or equal to 0.0008 inch (0.0203 mm) and less than or equal to 0.0020 inch (0.0508 mm). The apparatus, methods, and articles of manufacture described herein are not limited in this regard.

Given the greater widths and spacing of the first and second plurality of major grooves, the face portion 245 may be configured to include a plurality of merging events (e.g., shown as merging events 351, 352, and 353). Each merging event may be characterized by a major groove of the first plurality of major grooves (e.g., major groove 323) merging with an adjacent major groove of the second plurality of major grooves (e.g., major groove 332) at or proximate the middle face portion with the adjacent major groove of the second plurality of major grooves being positioned heel-ward relative to the major groove of the first plurality of major grooves. Additionally, as shown in the illustrated example, the first and second plurality of major grooves may be spaced apart to produce a plurality of converging events (e.g., shown as converging events 355, 356, 357, and 358). Each converging event may be characterized by a major groove of the first plurality of major grooves (e.g., major groove 323) converging with an adjacent major groove of the second plurality of major grooves (e.g., major groove 333) at or proximate the top edge 273 and the sole edge 274, respectively, with the adjacent major groove of the second plurality of major grooves being positioned toe-ward relative to the major groove of the first plurality of major grooves. The plurality of merging events and the plurality of converging events may repeatedly alternate in the heel-to-toe direction. In the illustrated example, the plurality of merging events may be bisected by the center horizontal plane 313 and merging event 352 may be additionally bisected by the center vertical plane 316. One or more additional merging events 351 may be spaced apart from merging event 352 in a heel-ward direction such that any two successive merging events (e.g., merging events 352 and 351) in the heel-ward direction may be separated by a converging event (e.g., converging event 356) at the top edge 273 and the sole edge 274, respectively. Similarly, one or more additional merging events 353 may be spaced apart from merging event 352 in a toe-ward direction such that any two successive merging events (e.g., merging events 352 and 353) in the toe-ward direction may be separated by a converging event (e.g., converging event 357) at the top edge 273 and the sole edge 274, respectively. By alternating between merging and converging events in a heel-to-toe direction, each major groove of the first plurality of major grooves and an adjacent major groove of the second plurality of major grooves in a toe-ward direction define a partially closed outline spread across the face portion 245 between the heel edge 272 and the toe edge 271. Accordingly, the first and second plurality of major grooves may define a plurality of closed outlines, which in the illustrated example of FIG. 3 are shown with phantom lines for purposes of illustration as closed outline 361 defined by major groove 321 of the first plurality of major grooves and major groove 331 of the second plurality of major grooves, closed outline 362 defined by major groove 322 of the first plurality of major grooves and major groove 332 of the second plurality of major grooves, closed outline 363 defined by major groove 323 of the first plurality of major grooves and major groove 333 of the second plurality of major grooves, and closed outline 364 defined major groove 324 of the first plurality of major grooves and major groove 334 of the second plurality of major grooves. Additionally, any two adjacent closed outlines (e.g., closed outlines 362 and 363) may partially overlap at a corresponding merging event (e.g., merging event 352). In the illustrated example, the closed outlines may each have a shape that is biconvex or substantially biconvex. The apparatus, methods, and articles of manufacture described herein are not limited in this regard.

The closed outlines may divide the plurality of projections 340 into a first plurality of projection clusters (shown in the illustrated example of FIG. 3 as projection clusters 371, 372, and 373), a second plurality of projection clusters (shown in the illustrated example of FIG. 3 as projection clusters 381, 382, and 383), and a third plurality of projection clusters (e.g., shown as projection clusters 391, 392, 393, and 394). Each projection cluster of the first plurality of projection clusters may be located in the upper region 302 between two adjacent closed outlines of the plurality of outlines, each projection cluster of the second plurality of projection clusters may be located in the lower region 303 between two adjacent closed outlines of the plurality of closed outlines, and each projection cluster of the third plurality of projection clusters may be located within a corresponding closed outline of the plurality of closed outlines. The apparatus, methods, and articles of manufacture described herein are not limited in this regard.

Figure 4:
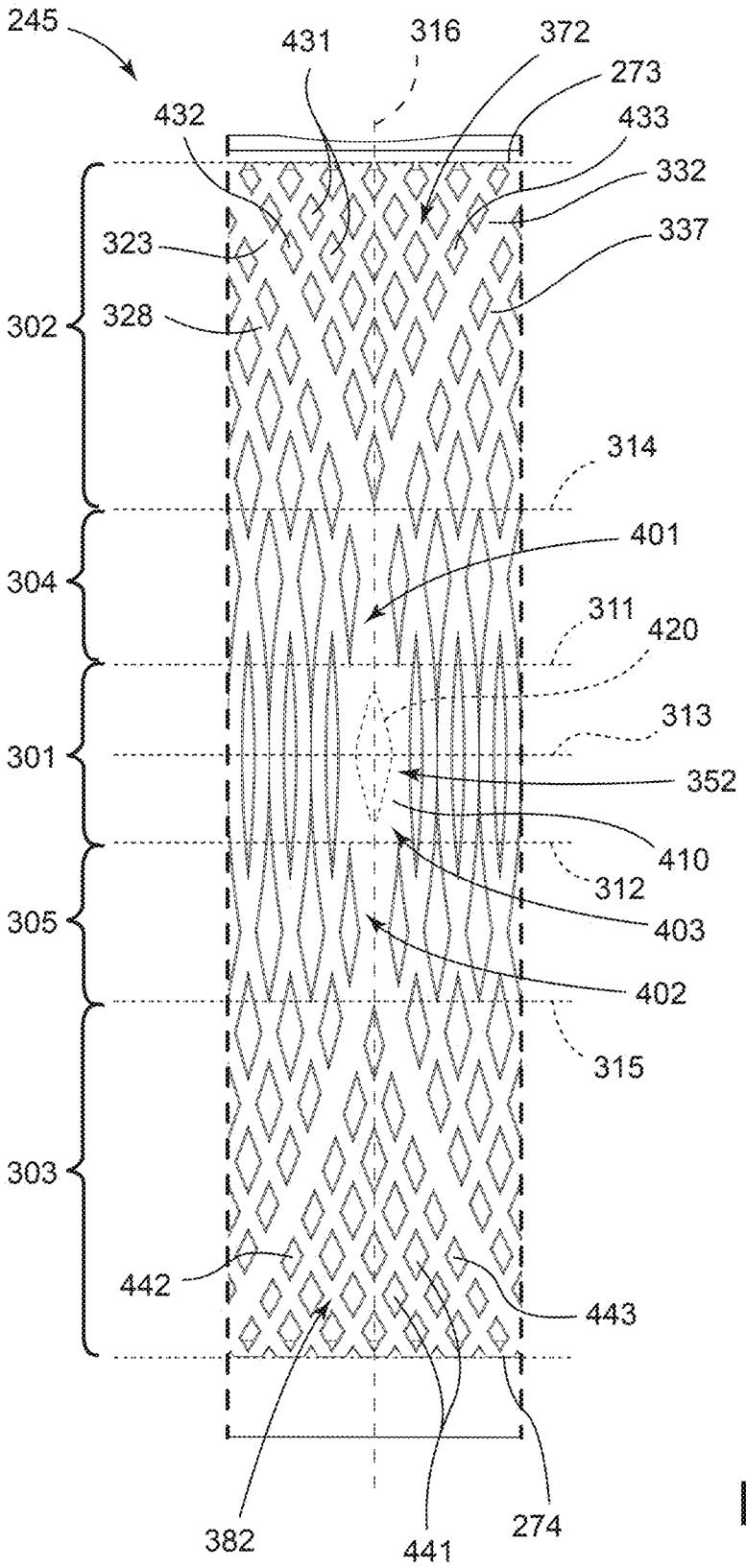
FIG. 4 depicts an enlarged view of area 4 of the face portion of FIG. 3.

With reference to FIG. 4, each merging event (e.g., merging event 352) may include a first merger 401 at or proximate the upper intermediate region 304 between a major groove of the first plurality of major grooves (e.g., major groove 323) and a major groove of the second plurality of major grooves (e.g., major groove 332), a second merger 402 at or proximate the lower intermediate region 305 between the major groove 323 of the first plurality of major grooves and the major groove 332 of the second plurality of major grooves, and a third merger 403 at or proximate the center region 301 between the major groove 323 of the first plurality of major grooves and the major groove 332 of the second plurality of major grooves. Additionally, the third merger 403 may include contributions from portions of a minor groove (e.g. minor groove 328) of the first plurality of minor grooves and a minor groove (e.g., minor groove 337) of the second plurality of minor grooves. The minor groove 328 of the first plurality of minor grooves may be located adjacent to the major groove 323 of the first plurality of major grooves and may be positioned toe-ward relative to the major groove 323 of the first plurality of major grooves. The minor groove 337 of the second plurality of minor grooves may be located adjacent to the major groove 332 of the second plurality of major grooves and may be positioned heel-ward relative to the major groove 332 of the second plurality of major grooves. Accordingly, the third merger 403 at the center region 301 may define a super groove 410 corresponding to an enlarged groove portion having a width along the center horizontal plane 313 that is greater than or equal to a sum of the corresponding widths of the grooves contributing to the merger (e.g., major groove 323 of the first plurality of major grooves, major groove 332 of the second plurality of major grooves, minor groove 328 of the first plurality of minor grooves, and minor groove 337 of the second plurality of minor grooves). In one example, the super groove 410 may be void of any projections. In another example, the super groove 410 may enclose one or more projections (e.g., a single projection 420 is shown in phantom lines for purpose of illustration) having physical properties (e.g., shape, dimension, etc.) that may be similar to or different from the physical properties of any of the projections described herein. The apparatus, methods, and articles of manufacture described herein are not limited in this regard.

Figure 5:
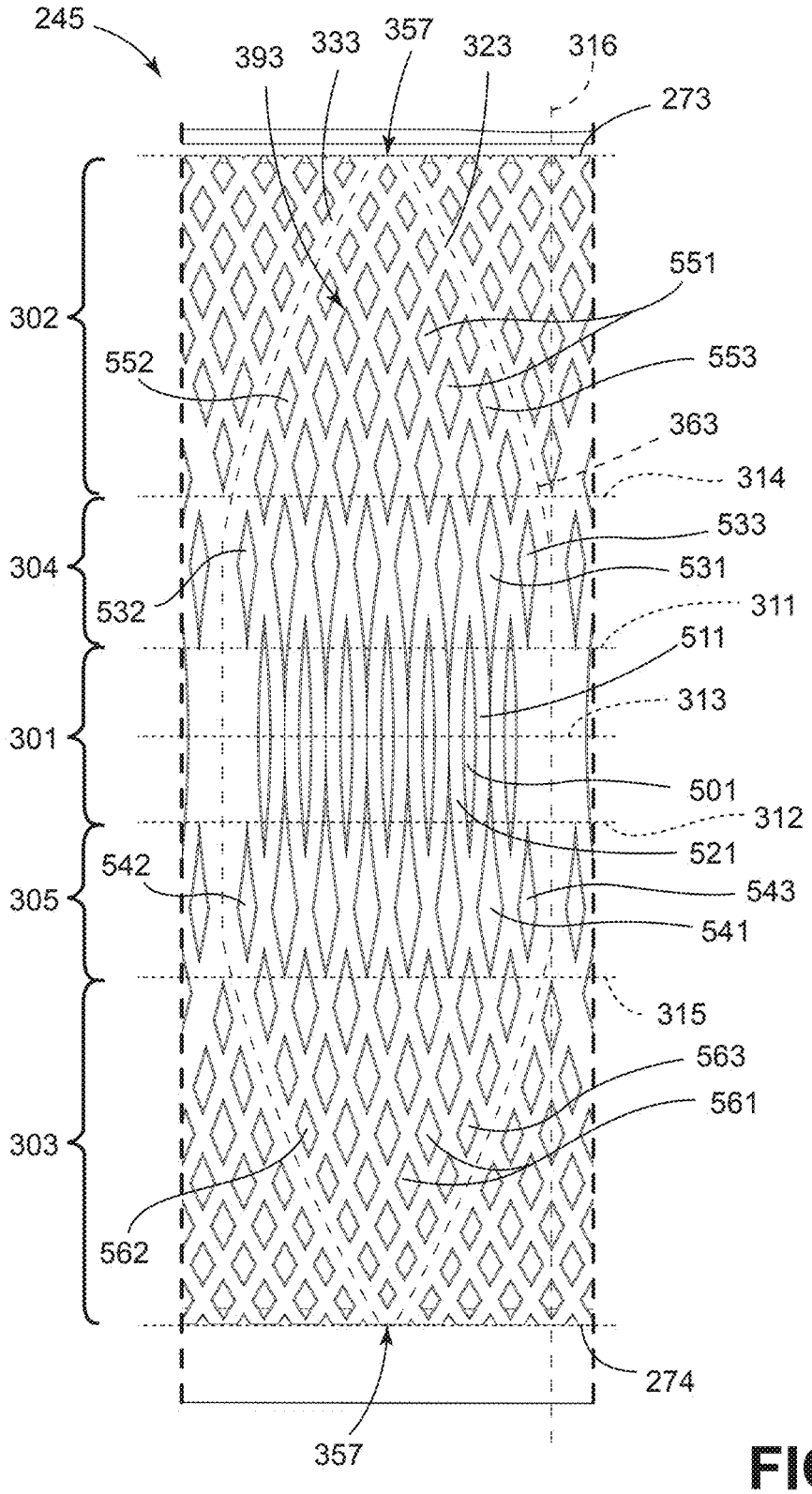
FIG. 5 depicts an enlarged view of area 5 of the face portion of FIG. 3.

In the example of FIG. 5, each converging event (e.g., converging event 357) may include a major groove (e.g., major groove 323) of the first plurality of major grooves converging with a major groove (e.g., major groove 333) of the second plurality of major grooves at or proximate the top edge 273 and the sole edge 274, respectively. With respect to any of the examples provided herein, a particular major groove of the first or second plurality of major grooves may participate in one or both of a merging event and a converging event as described herein. The apparatus, methods, and articles of manufacture described herein are not limited in this regard.

Referring back to the example of FIG. 4, each projection cluster of the first plurality of projection clusters (e.g., projection cluster 372) may be located in the upper region 302 above the first merger 401 between the major groove 323 of the first plurality of major grooves and the major groove 332 of the second plurality of major grooves. Each projection cluster of the second plurality of projection clusters (e.g., projection cluster 382) may be located in the lower region 303 below the second merger 402 between the major groove 323 of the first plurality of major grooves and the major groove 332 of the second plurality of major grooves. Projection cluster 372 may have a triangle or triangle-like outline (i.e., three-sided shape) defined by the top edge 273, major groove 323 of the first plurality of major grooves, and major groove 332 of the second plurality of major grooves, respectively. Projection cluster 372 may include a plurality of projections 431 arranged in a series of rows to define an array of projections substantially located in the upper region 302. As described herein, a projection may be considered to be substantially located within a particular face region if more than half of the projection's volume is located in the particular face region. Each row of projections 431 may include one or more projections 431 and the projection(s) 431 of a given row may be staggered relative to the projection(s) 431 of an adjacent row located above or below the given row. Projections 431 may have similar or different peak surface areas with respect to each other. In one example, the projections 431 may each define a peak surface area having a quadrilateral shape (e.g., a diamond or diamond-like shape) and the rows of projections 431 may increase in projection number when moving vertically across the upper region 302 from the third horizontal plane 314 toward the top edge 273. For any row having only two projections 431, the corresponding peak surface areas may be similar (e.g., same size and shape), whereas for any row having three or more projections 431, the two end projections (e.g., end projections 432 and 433) of the row may have similar peak surface areas that may differ in size and/or shape from the peak surface areas of the remaining projection(s) 431 within the same row. As shown in the illustrated example, the two end projections 432 and 433 may have peak surface areas that are smaller in size than the peak surface areas of the three remaining projections 431 within the same row. Additionally, the projections 431 may generally decrease in peak surface area when moving vertically across the upper region 302 from the third horizontal plane 314 toward the top edge 273. The apparatus, methods, and articles of manufacture described herein are not limited in this regard.

Projection cluster 382 may have a triangle or triangle-like outline (i.e., a three-sided shape) defined by the sole edge 274, major groove 323 of the first plurality of major grooves, and major groove 332 of the second plurality of major grooves, respectively. Projection cluster 382 may include a plurality of projections 441 arranged in a series of rows to define an array of projections substantially located in the lower region 303. Each row of projections 441 may include one or more projections 441 and the projection(s) 441 of a given row may be staggered relative to the projection(s) 441 of an adjacent row located above or below the given row. Projections 441 may have similar or different peak surface areas with respect to each other. In one example, the projections 441 may each define a peak surface area having a quadrilateral shape (e.g., a diamond or diamond-like shape) and the rows of projections 441 may increase in projection number when moving vertically across the lower region 303 from the fourth horizontal plane 315 toward the sole edge 274. For any row having only two projections 441, the corresponding peak surface areas may be similar (e.g., same size and shape), whereas for any row having three or more projections 441, the two end projections (e.g., end projections 442 and 443) may have similar peak surface areas that differ in size and/or shape from the peak surface areas of the remaining projection(s) within the same row. As shown in the illustrated example, the two end projections 442 and 443 may have peak surface areas that are smaller in size than the peak surface areas of the three remaining projections 441 within the same row. Additionally, the projections 441 may generally decrease in peak surface area when moving vertically across the lower region 303 from the fourth horizontal plane 315 toward the sole edge 274. In the illustrated example, projection clusters 372 and 382 may mirror each other about the center horizontal plane 313. The apparatus, methods, and articles of manufacture described herein are not limited in this regard.

Referring back to the example of FIG. 5, each projection cluster of the third plurality of projection clusters (e.g., projection cluster 393) may include one or more projections located in one or more of the center region 301, the upper region 302, the lower region 303, the upper intermediate region 304, and the lower intermediate region 305. Projection cluster 393 may have a shape that is complementary to a corresponding closed outline (e.g., closed outline 363). In the illustrated example, projection cluster 393 may include a plurality of projections 501 arranged in a row substantially located in the center region 301. The projections 501 may have similar or different peak surface areas with respect to each other. In one example, the projections 501 may each define a peak surface area having a fusiform shape (i.e., spindle-like shape that is wide in the middle and tapers at both ends) shape extending lengthwise in a sole-to-top direction and the peak surface areas of the projections 501 may be similar (e.g., same size and shape) to each other. Each one of the projections 501 may be enclosed by a corresponding minor groove (e.g., minor groove 511) of the first plurality of minor grooves and a corresponding minor groove (e.g., minor groove 521) of the second plurality of minor grooves. In the illustrated example, the first and second plurality of minor grooves may not intersect with each other in the center region 301. Additionally, the projections 501 may exhibit mirror symmetry about the center horizontal plane 313. The apparatus, methods, and articles of manufacture described herein are not limited in this regard.

Projection cluster 393 may also include a plurality of projections 531 arranged in a row substantially located in the upper intermediate region 304 and a plurality of projections 541 arranged in a row substantially located in the lower intermediate region 305. Projections 531 may have similar or different peak surface areas with respect to each other. In one example, projections 531 may each define a peak surface area having a quadrilateral shape (e.g., a diamond or diamond-like shape). The projections 531 may have similar peak surface areas (e.g., same shape and size) except for two end projections (e.g., end projections 532 and 533) having similar peak surface areas that may differ in size and/or shape from the remaining projections 531 in the row. As shown in the illustrated example, the two end projections 532 and 533 may have peak surface areas that are smaller in size than the peak surface areas of the six remaining projections 531 in the row. Likewise, projections 541 may have similar or different peak surface areas with respect to each other. In one example, projections 541 may each define a peak surface area having a quadrilateral shape (e.g., a diamond or diamond-like shape). The projections 541 may have similar peak surface areas (e.g., same shape and size) except for two end projections (e.g., end projections 542 and 543) having similar peak surface areas that may differ in size and/or shape from the remaining projections 541 in the row. As shown in the illustrated example, the two end projections 542 and 543 may have peak surface areas that are smaller in size than the peak surface areas of the six remaining projections 541 in the row. Additionally, with respect to the illustrated example, the row of projections 531 may mirror the row of projections 541 about the center horizontal plane 313. The apparatus, methods, and articles of manufacture described herein are not limited in this regard.

Projection cluster 393 may further include a plurality of projections 551 arranged in a series of rows to define an array or projections substantially located in the upper region 302 and a plurality of projections 561 arranged in a series of rows to define an array of projections substantially located in the lower region 303. Each row of projections 551 may include one or more projections 551 and the projection(s) 551 of a given row may be staggered relative to the projection(s) 551 of an adjacent row located above or below the given row. Projections 551 may have similar or different peak surface areas with respect to each other. In one example, projections 551 may each define a peak surface area having a quadrilateral shape (e.g., a diamond or diamond-like shape) and the rows of projections 551 may decrease in projection number when moving vertically across the upper region 302 from the third horizontal plane 314 toward the top edge 273. For any row having only two projections 551, the corresponding peak surface areas may be similar (e.g., same size and shape), whereas for any row having three or more projections 551, the two end projections (e.g., end projections 552 and 553) of the row may have similar peak surface areas that may differ in size and/or shape from the peak surface areas of the remaining projection(s) 551 within the same row. As shown in the illustrated example, the two end projections 552 and 553 may have peak surface areas that are smaller in size than the peak surface areas of the four remaining projections 551 within the same row. Additionally, the projections 551 may generally decrease in peak surface area when moving vertically across the upper region 302 from the third horizontal plane 314 toward the top edge 273. The apparatus, methods, and articles of manufacture described herein are not limited in this regard.

Each row of projections 561 may include one or more projections 561 and the projection(s) 561 of a given row may be staggered relative to the projection(s) 561 of an adjacent row located above or below the given row. Projections 561 may have similar or different peak surface areas with respect to each other. In one example, projections 561 may each define a peak surface area having a quadrilateral shape (e.g., a diamond or diamond-like shape) and the rows of projections 561 may decrease in projection number when moving vertically across the lower region 303 from the fourth horizontal plane 315 toward the sole edge 274. For any row having only two projections 561, the corresponding peak surface areas may be similar (e.g., same size and shape), whereas for any row having three or more projections 561, the two end projections (e.g., end projections 562 and 563) of the row may have similar peak surface areas that may differ in size and/or shape from the peak surface areas of the remaining projection(s) 561 within the same row. As shown in the illustrated example, the two end projections 562 and 563 may have peak surface areas that are smaller in size than the peak surface areas of the three remaining projections 561 within the same row. Additionally, the projections 561 may generally decrease in peak surface area when moving vertically across the lower region 303 from the fourth horizontal plane 315 toward the sole edge 274. With respect to the illustrated example, the rows of projections 551 may mirror the rows of projections 561 about the center horizontal plane 313. The apparatus, methods, and articles of manufacture described herein are not limited in this regard.

Relative to the center, upper intermediate, and lower intermediate regions 301, 304, and 305, projection cluster 393 may have the greatest projection density in the upper region 302 and the lower region 303, respectively. In one example, the projections 501 in the center region 301 may each have a length in a sole-to-top direction that is greater than a corresponding length of any one of the projections in the other face regions of the face portion 245. Additionally the projections 501 in the center region 301 may each have a central width (e.g., taken along the center horizontal plane 313) that is less than a corresponding central width of any one of the projections in the other face regions of the face portion 245. The apparatus, methods, and articles of manufacture described herein are not limited in this regard.

Figure 6:
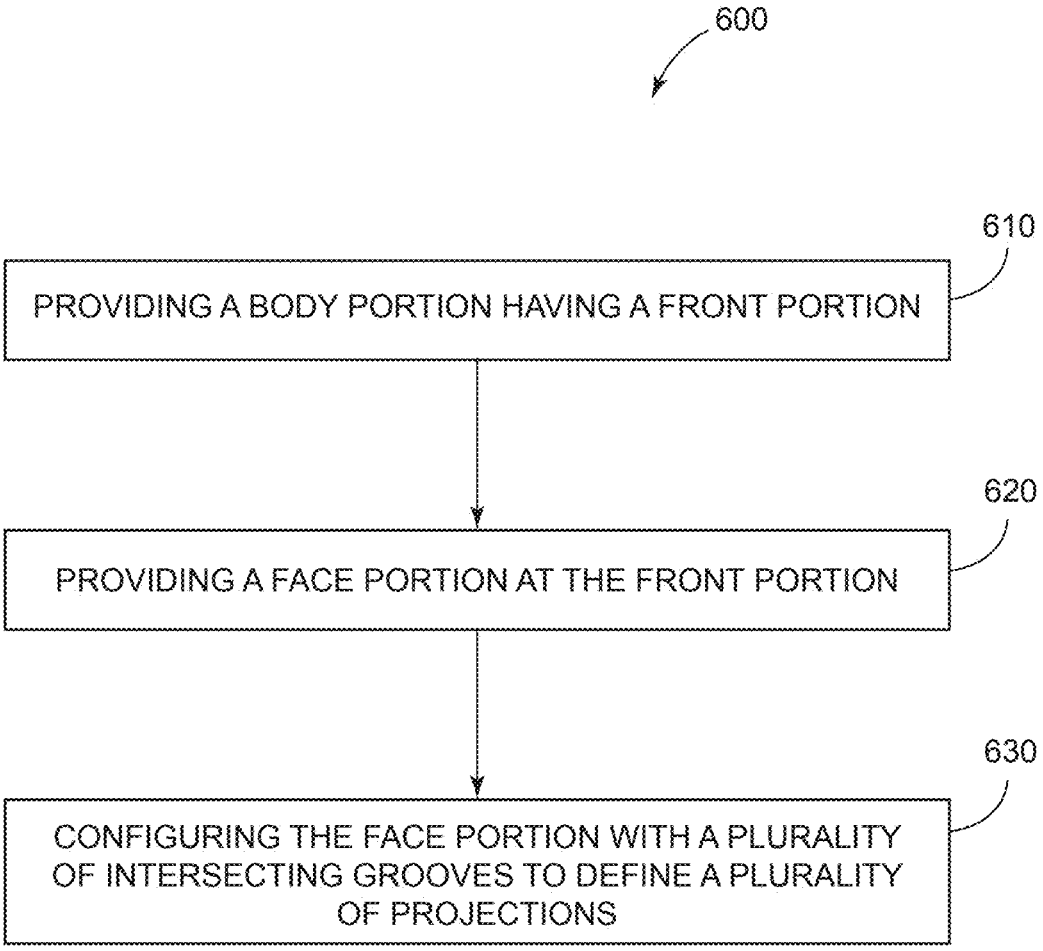
FIG. 6 depicts a process for manufacturing a golf club head according to an embodiment of the apparatus, methods, and articles of manufacture described herein.

FIG. 6 depicts a process 600 by which the golf club head 200 described herein may be manufactured. In the example of FIG. 6, the process 600 may include providing a body portion 210 having a front portion 240 (block 610), a face portion 245 may be provided at the front portion 240 (block 620). The face portion 245 may be configured with a plurality of intersecting grooves (e.g., the first and second plurality of major and minor grooves) to define a plurality of projections (e.g., plurality of projections 340) (block 630). In one example, the plurality of grooves may be formed in the face portion 245 using a milling process or other suitable process. The apparatus, methods, and articles of manufacture described herein are not limited in this regard.

While the above examples and figures may depict a face portion with a particular groove pattern, the apparatus, methods, and articles of manufacture described herein may include other variations. In one example, the groove pattern described herein may be shifted toward the toe edge, the heel edge, the top edge, the sole edge, or a combination thereof. Additionally or alternatively, the groove pattern may be rotated clockwise or counterclockwise. In some examples, portions of the groove pattern may be truncated or eliminated in certain areas of the face portion due to its particular shape and contour. While the grooves are generally described herein as arcuate, any of the grooves described herein may be otherwise configured as linear, curvilinear, stepped, zigzagged, etc. Additionally or alternatively, any of the grooves described herein may be continuous or discontinuous. In other examples, any of the projections described herein may be configured to have other shapes such as, but not limited to, circular shapes, triangle shapes, oval shapes, ellipsoid shapes, quadrilateral shapes, polygonal shapes, regular geometric shapes, irregular geometric shapes, etc. The apparatus, methods, and articles of manufacture described herein are not limited in this regard.

While each of the above examples may describe a certain type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, a putter-type golf club head, etc.).

Procedures defined by golf standard organizations and/or governing bodies such as the United States Golf Association (USGA) and/or the Royal and Ancient Golf Club of St. Andrews (R&A) may be used for measuring the club head volume of any of the golf club heads described herein. For example, a club head volume may be determined by using the weighted water displacement method (i.e., Archimedes Principle). Although the figures may depict particular types of club heads (e.g., a driver-type club head or iron-type golf club head), the apparatus, methods, and articles of manufacture described herein may be applicable to other types of club head (e.g., a fairway wood-type club head, a hybrid-type club head, a putter-type club head, etc.). Accordingly, any golf club head as described herein may have a volume that is within a volume range corresponding to certain type of golf club head as defined by golf governing bodies, a driver-type golf club head may have a club head volume of greater than or equal to 300 cc. In another example, a driver-type golf club head may have a club head volume of 460 cc, a fairway wood golf club head may have a club head volume of between 100 cc and 300 cc. In one example, a fairway wood golf club head may have a club head volume of 180 cc. An iron-type golf club head may have a club head volume of between 25 cc and 100 cc. In one example, an iron-type golf club head may have a volume of 50 cc. Any of the golf clubs described herein may have the physical characteristics of a certain type of golf club (i.e., driver, fairway wood, iron, etc.), but have a volume that may fall outside of the above-described ranges. The apparatus, methods, and articles of manufacture described herein are not limited in this regard.

Any of the golf club heads and/or golf clubs described herein may include one or more sensors (e.g., accelerometers, strain gauges, etc.) for sensing linear motion (e.g., acceleration) and/or forces in all three axes of motion and/or rotational motion (e.g., angular acceleration) and rotational forces about all three axes of motion. In one example, the one or more sensors may be internal sensors that may be located inside the golf club head, the hosel, the shaft, and/or the grip. In another example, the one or more sensors may be external sensors that may be located on the grip, on the shaft, on the hosel, and/or on the golf club head. In yet another example, the one or more sensors may be external sensors that may be attached by an individual to the grip, to the shaft, to the hosel, and/or to the golf club head. In one example, data collected from the sensors may be used to determine any one or more design parameters for any of the golf club heads and/or golf clubs described herein to provide certain performance or optimum performance characteristics. In another example, data from the sensors may be collected during play to assess the performance of an individual. The apparatus, methods, and articles of manufacture described herein are not limited in this regard.

Any of the apparatus, methods, or articles of manufacture described herein may include one or more visual identifiers such as alphanumeric characters, colors, images, symbols, logos, and/or geometric shapes. For example, one or more visual identifiers may be manufactured with one or more portions of a golf club such as the golf club head (e.g., casted or molded with the golf club head), painted on the golf club head, etched on the golf club (e.g., laser etching), embossed on the golf club head, machined onto the golf club head, attached as a separate badge or a sticker on the golf club head (e.g., adhesive, welding, brazing, mechanical lock(s), any combination thereof, etc.), or any combination thereof. The visual identifier may be made from the same material as the golf club head or a different material than the golf club head (e.g., a plastic badge attached to the golf club head with an adhesive). Further, the visual identifier may be associated with manufacturing and/or brand information of the golf club head, the type of golf club head, one or more physical characteristics of the golf club head, or any combination thereof. In particular, a visual identifier may include a brand identifier associated with a manufacturer of the golf club (e.g., trademark, trade name, logo, etc.) or other information regarding the manufacturer. In addition, or alternatively, the visual identifier may include a location (e.g., country of origin), a date of manufacture of the golf club or golf club head, or both.

The visual identifier may include a serial number of the golf club or golf club head, which may be used to check the authenticity to determine whether or not the golf club or golf club head is a counterfeit product. The serial number may also include other information about the golf club that may be encoded with alphanumeric characters (e.g., country of origin, date of manufacture of the golf club, or both). In another example, the visual identifier may include the category or type of the golf club head (e.g., 5-iron. 7-iron, pitching wedge, etc.). In yet another example, the visual identifier may indicate one or more physical characteristics of the golf club head, such as one or more materials of manufacture (e.g., visual identifier of "Titanium" indicating the use of titanium in the golf club head), loft angle, face portion characteristics, mass portion characteristics (e.g., visual identifier of "Tungsten" indicating the use of tungsten mass portions in the golf club head), interior cavity and filler material characteristics (e.g., one or more abbreviations, phrases, or words indicating that the interior cavity is filled with a polymer material), any other information that may visually indicate any physical or play characteristic of the golf club head, or any combination thereof. Further, one or more visual identifiers may provide an ornamental design or contribute to the appearance of the golf club, or the golf club head.

Any of the golf club heads described herein may be manufactured by casting from metal such as steel. However, other techniques for manufacturing a golf club head as described herein may be used such as 3D printing or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

The terms "and" and "or" may have both conjunctive and disjunctive meanings. The terms "a" and "an" are defined as one or more unless this disclosure indicates otherwise. The term "coupled," and any variation thereof, refers to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby," "neighboring," etc., and such terms may be used interchangeably as appearing in this disclosure.

Recitation of ranges of values herein is merely intended to serve as a shorthand method of referring individually to each separate value falling within the range. Unless otherwise indicated herein, each individual value is incorporated into the specification as if it were individually recited herein, a numerical range defined using the word "between" includes numerical values at both end points of the numerical range, a spatial range defined using the word "between" includes any point within the spatial range and the boundaries of the spatial range, a location expressed relative to two spaced apart or overlapping elements using the word "between" includes (i) any space between the elements, (ii) a portion of each element, and/or (iii) the boundaries of each element.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods, and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion have a front portion;

a face portion at the front portion, the face portion comprising:

a perimeter including a toe edge, a heel edge, a top edge, and a sole edge;

a center region intersected by a center horizontal plane;

an upper region adjacent the top edge;

a lower region adjacent the sole edge;

an upper intermediate region between the center region and the upper region;

a lower intermediate region between the center region and the lower region;

a first plurality of major grooves spaced across the face portion in a heel-to-toe direction and extending in a first arcuate direction between the top edge and the sole edge;

a first plurality of minor grooves spaced across the face portion in the heel-to-toe direction and extending in the first arcuate direction between the top edge and the sole edge;

a second plurality of major grooves spaced across the face portion in the heel-to-toe direction and extending in a second arcuate direction between the top edge and the sole edge;

a second plurality of minor grooves spaced across the face portion in the heel-to-toe direction and extending in the second arcuate direction between the top edge and the sole edge;

a plurality of projections defined by the first and second plurality of major and minor grooves; and a plurality of merging events, each merging event comprising:

a first merger at the upper intermediate region between a major groove of the first plurality of major grooves and a major groove of the second plurality of major grooves;

a second merger at the lower intermediate region between the major groove of the first plurality of major grooves and the major groove of the second plurality of major grooves; and a third merger at the center region between the major groove of the first plurality of grooves, the major groove of the second plurality of major grooves, a minor groove of the first plurality of minor grooves, and a minor groove of the second plurality of minor grooves, wherein the second arcuate direction is opposite to the first arcuate direction, wherein the first plurality of major grooves have widths that are greater than the widths of the first plurality of minor grooves, wherein the second plurality of major grooves have widths that are greater than the widths of the second plurality of minor grooves, wherein any two successive major grooves of the first plurality of major grooves are separated by a plurality of minor grooves of the first plurality of minor grooves, wherein any two successive major grooves of the second plurality of major grooves are separated by a plurality of minor grooves of the second plurality of minor grooves, and wherein the third merger defines a super groove corresponding to an enlarged groove portion void of any projections.

2. A golf club head as defined in claim 1, further comprising a plurality of converging events, wherein each converging event is defined by a major groove of the first plurality of major grooves converging with a major groove of the second plurality of major grooves at or proximate the top edge and the sole edge.

3. A golf club head as defined in claim 1, wherein the first plurality of major grooves have similar widths to the second plurality of major grooves.

4. A golf club head as defined in claim 1, wherein the first plurality of minor grooves have similar widths to the second plurality of minor grooves.

5. A golf club head as defined in claim 1, wherein the plurality of projections have a greatest projection density in the upper region and the lower region.

6. A golf club head as defined in claim 1, wherein one or more projections of the plurality of projections have a diamond or diamond-like shape.

7. A golf club head as defined in claim 1, wherein the first and second plurality of major and minor grooves have similar depths.

8. A golf club head comprising:

a face portion comprising:

a perimeter including a toe edge, a heel edge, a top edge, and a sole edge;

a first plurality of major grooves spaced across the face portion in a heel-to-toe direction and extending in a first arcuate direction between the top edge and the sole edge;

a first plurality of minor grooves spaced across the face portion in the heel-to-toe direction and extending in the first arcuate direction between the top edge and the sole edge;

a second plurality of major grooves spaced across the face portion in the heel-to-toe direction and extending in a second arcuate direction between the top edge and the sole edge;

a second plurality of minor grooves spaced across the face portion in the heel-to-toe direction and extending in the second arcuate direction between the top edge and the sole edge;

a plurality of projections defined by the first and second plurality of major and minor grooves;

a first merging event defined by a first major groove of the first plurality of major grooves merging with a first major groove of the second plurality of major grooves;

a second merging event defined by a second major groove of the first plurality of major grooves merging with a second major groove of the second plurality of major grooves, the second merging event spaced apart from the first merging event in a heel-ward direction;

a third merging event defined by a third major groove of the first plurality of major grooves merging with a third major groove of the second plurality of major grooves, the third merging event spaced apart from the first merging event in a toe-ward direction;

a first converging event defined by the second major groove of the first plurality of major grooves converging with the first major groove of the second plurality of major grooves at or proximate the top edge and the sole edge, the first converging event separating the first merging event and the second merging event; and a second converging event defined by the first major groove of the first plurality of major grooves converging with the third major groove of the second plurality of major grooves at or proximate the top edge and the sole edge, the second converging event separating the first merging event and the third merging event, wherein the second direction is opposite to the first direction, wherein the first plurality of major grooves have widths that are different from the widths of the first plurality of minor grooves, wherein the second plurality of major grooves have widths that are different from the widths of the second plurality of minor grooves, wherein the first major groove of the first plurality of major grooves is separated from each of the second and third major grooves of the first plurality of major grooves by one or more minor grooves of the first plurality of minor grooves, wherein the first major groove of the second plurality of major grooves is separated from each of the second and third major grooves of the second plurality of major grooves by one or more minor grooves of the second plurality of minor grooves, and wherein the first, second, and third merging events are bisected by a center horizontal plane located halfway between the top edge and the sole edge.

9. A golf club head as defined in claim 8, wherein at least one of the first, second, or third merging events defines an enlarged groove portion void of any projections.

10. A golf club head as defined in claim 8, wherein at least one of the first, second, or third merging events defines an enlarged groove enclosing one or more projections.

11. A golf club head as defined in claim 8, wherein the first, second, and third major grooves of the first plurality of major grooves are convex in a heel-ward direction, and wherein the first, second, and third major grooves of the second plurality of major grooves are convex in a toe-ward direction.

12. A golf club head as defined in claim 8, wherein the plurality of projections include a first projection cluster located proximate the top edge and enclosed by the first major groove of the first plurality of major grooves and the first major groove of the second plurality of major grooves, a second projection cluster located proximate the top edge and enclosed by the second major groove of the first plurality of major grooves and the second major groove of the second plurality of major grooves, and a third projection cluster located proximate the top edge and enclosed by the third major groove of the first plurality of major grooves and the third major groove of the second plurality of major grooves, wherein the first, second, and third projection clusters are each configured in an array having a triangle or triangle-like shape.

13. A golf club head as defined in claim 8, wherein the plurality of projections include a first projection cluster located proximate the sole edge and enclosed by the first major groove of the first plurality of major grooves and the first major groove of the second plurality of major grooves, a second projection cluster located proximate the sole edge and enclosed by the second major groove of the first plurality of major grooves and the second major groove of the second plurality of major grooves, and a third projection cluster located proximate the sole edge and enclosed by the third major groove of the first plurality of major grooves and the third major groove of the second plurality of major grooves, wherein the first, second, and third projection clusters are each configured in an array having a triangle or triangle-like shape.

14. A golf club head as defined in claim 8, wherein the plurality of projections include a first projection cluster enclosed by the first major groove of the first plurality of grooves and the third major groove of the second plurality of grooves and a second projection cluster enclosed by the first major groove of the second plurality of major grooves and the second major groove of the first plurality of major grooves, wherein the first and second projection clusters are each configured in an array having a biconvex or substantially biconvex shape.

15. A golf club head comprising:

a face portion comprising:

a perimeter defined by a toe edge, a heel edge, a top edge, and a sole edge;

a first plurality of major grooves spaced across the face portion in a heel-to-toe direction, each major groove of the first plurality of major grooves extending in a first arcuate direction between the top edge and the sole edge;

a first plurality of minor grooves spaced across the face portion in the heel-to-toe direction, each minor groove of the first plurality of minor grooves extending in the first arcuate direction between the top edge and the sole edge;

a second plurality of major grooves spaced apart from each other in the heel-to-toe direction, each major groove of the second plurality of major grooves extending in a second arcuate direction between the top edge and sole edge; and a second plurality of minor grooves spaced apart from each other in the heel-to-toe direction, each minor groove of the second plurality of minor grooves extending in the second arcuate direction between the top edge and the sole edge, wherein the first arcuate direction is opposite to the second arcuate direction, wherein each major groove of the first plurality of major grooves has a width greater than a width of each minor groove of the first plurality of minor grooves, wherein each major groove of the second plurality of major grooves has a width greater than a width of each minor groove of the second plurality of minor grooves, wherein any two successive major grooves of the first plurality of major grooves are separated by one or more minor grooves of the first plurality of minor grooves, and wherein any two successive major grooves of the second plurality of major grooves are separated by one or more minor grooves of the second plurality of minor grooves.

16. A golf club head as defined in claim 15, wherein first plurality of major and minor grooves are convex in a heel-ward direction and the second plurality of major and minor grooves are convex in a toe-ward direction.

17. A golf club head as defined in claim 15, wherein the first plurality of major grooves have similar widths to the second plurality of major grooves, and wherein the first plurality of minor grooves have similar widths to the second plurality of minor grooves.

18. A golf club head as defined in claim 15, wherein the width of each major groove of the first and second plurality of major grooves is more than one and a half times greater than the width of each minor groove minor groove of the first and second plurality of minor grooves.

19. A golf club head as defined in claim 15, wherein a portion of each major groove of the first plurality of major grooves converges with a portion of an adjacent major groove of the second plurality of major grooves.

20. A golf club head as defined in claim 15, wherein a portion of each major groove of the first plurality of major grooves merges with a portion of an adjacent major groove of the second plurality of major grooves.

* * * * *